US010944171B2

(12) United States Patent
O'Leary

(10) Patent No.: US 10,944,171 B2
(45) Date of Patent: Mar. 9, 2021

(54) FAST TRANSCEIVER FRONT END SERIAL CONTROL

(71) Applicant: pSemi Corporation, San Diego, CA (US)

(72) Inventor: Mark James O'Leary, San Diego, CA (US)

(73) Assignee: pSemi Corporation, San Diego, CA (US)

( * ) Notice: Subject to any disclaimer, the term of this patent is extended or adjusted under 35 U.S.C. 154(b) by 220 days.

(21) Appl. No.: 16/109,296

(22) Filed: Aug. 22, 2018

(65) Prior Publication Data

US 2020/0067185 A1 Feb. 27, 2020

(51) Int. Cl.
*H01Q 3/28* (2006.01)
*H01Q 3/34* (2006.01)

(52) U.S. Cl.
CPC ..... *H01Q 3/28* (2013.01); *H01Q 3/34* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,020,488 | B1 * | 3/2006 | Bleile | H04W 88/021 455/414.1 |
| 10,651,920 | B1 * | 5/2020 | Struhsaker | H04B 7/084 |
| 10,686,487 | B2 * | 6/2020 | Kirkpatrick | H04B 1/48 |
| 2011/0263214 | A1 * | 10/2011 | Robinson | H04B 1/0458 455/88 |
| 2015/0333781 | A1 * | 11/2015 | Alon | H03F 3/19 370/277 |
| 2016/0094187 | A1 * | 3/2016 | Staudinger | H03F 3/19 330/295 |
| 2016/0315676 | A1 * | 10/2016 | Mammoser | H04B 7/088 |
| 2017/0017534 | A1 * | 1/2017 | De Amici | G01S 7/4021 |
| 2017/0041038 | A1 * | 2/2017 | Kirkpatrick | H01Q 3/36 |
| 2018/0006371 | A1 * | 1/2018 | Dang | G01S 19/02 |
| 2020/0091608 | A1 * | 3/2020 | Alpman | H01Q 5/47 |

* cited by examiner

*Primary Examiner* — Mamadou L Diallo
(74) *Attorney, Agent, or Firm* — Jaquez Land Greenhaus LLP; Alessandro Steinfl, Esq.

(57) ABSTRACT

Devices and methods for reconfiguration of electronic circuits in multi-antenna communication systems are described. Using indexed programmable lookup tables, phase and gain information related to the antenna array implemented in such system is accessed. Same method may be used to reconfigure state of transceivers and other electronic circuits within such systems. The described methods and devices can be implemented using standardized serial interfaces.

7 Claims, 4 Drawing Sheets

400

400

FAST TRANSCEIVER FRONT END SERIAL CONTROL

BACKGROUND

(1) Technical Field

The present disclosure is related to reconfiguration of transceiver front ends in communication systems, and more particularly to methods and apparatus for fast serial control of a transceiver front end.

(2) Background

FIG. 1 shows a block diagram of a known multi-antenna communication system having M transceivers. Each transceiver i, i=1, 2, . . . , is connected with a corresponding antenna, ANTi, i=1, 2, . . . , M. Each of the transceivers includes a transmitter, a receiver, a gain and phase control block, control switches (e.g. S11, S21 for transceiver 1, . . . , and S1M and S2M for transceiver M) and a digital control circuit. The digital control circuits provide control bits used to configure/reconfigure corresponding transceivers into certain modes of operation. As an example, if transceiver 1 is in receive mode, the corresponding digital control circuit will provide control bits to set the corresponding transmitter in an OFF (or sleep) state and a corresponding receiver in an ON state. Corresponding switches are also set into proper states in accordance with the mode the transceiver is operating in, transmit mode in this case.

Moreover and continuing with the same example, depending on the location of the user, specific gain and phase for ANT1 is set for the best acquisition of the user.

Depending on the size, complexity and the number of transceivers, configuration/reconfiguration of various circuits in such systems may be a challenging task. By way of example, some beamforming applications may involve a large array of antennas (similar to what shown in FIG. 1) which may be pointing at different directions based on operative conditions. In order to acquire a user, directions of the antennas may be scanned to find the right direction of the user. In order to perform such scanning, reconfiguration of gain and phase between subsequent scanning steps are required and this results in a large overhead on the system.

Continuing with the same example, the total number of control bits to change during reconfiguration, will be the number of bits required to change the phase and gain of each transceiver multiplied by the number of transceivers. Especially for larger multi-antenna systems with 64, 128 or 256 transceivers, the reconfiguration time may result in long delays that are often prohibitive due to timing constraints based on which such systems are designed. As a further example, a simple change from transmit to receive mode in between subsequent slots may also involve a change in beam direction. In this case, a certain number of control bits are required, at least, to change the gain and phase of some transceivers, to switch some transmitters to ON state and some receivers to OFF or sleep or semi-sleep state, to change the states of some switches (e.g. switches S11, S21, . . . S1*i*, S2*i*, . . . S2 of FIG. 1) and possibly to change bias states of some transceiver circuitry. Similarly to what described above, in complex systems having a large number of transceivers, this will put some additional stress and burden on various electronic circuits within transceivers. Generally speaking, reconfiguration in communication systems may encompass changing the transceiver mode (transmit, receive, neutral or sleep), the center frequency, the relative gain and phase of each transceiver (in beamforming systems or the systems such as shown in FIG. 1) and the common gain. Some systems may also use specialty modes for loopback, self-test, calibration, etc. Designing systems capable of absorbing large delays due to reconfigurations that are required during operation is a challenging problem.

One solution to the above-mentioned problem is parallel control. The benefit of such approach is the simplicity of front end design. However, the disadvantage of this strategy is the large number of required wires. In large antenna array systems, implementation of parallel control may be prohibitive due to wiring density. An alternative solution would be serial control with the advantage of having a reduced number of wires between the control master and the front end. The issue with such approach is speed. As an example, a typical complementary metal-oxide-semiconductor (CMOS) interface that requires relatively low power, generates low emission and is standardized (e.g. serial peripheral interface, SPI®, or Mobile Industry Processor Interface, MiPi®)), may be limited to around 100 MHz clock speed. Hundreds of control bits times 10 ns/bit clock speed will quickly result in unacceptable delays. In other words, the clock speed is an issue with such interfaces. A solution to overcome the speed issue is to use faster serial control (e.g. up to Gbits/sec). Such solution comes with some disadvantages. Serial fast controllers are power hungry, complex to implement, liable to emissions and are not commonly supported by transceiver baseband implementations. Moreover, such fast serial controllers come frequently with required royalties. The reason for this is that due to complexity of the design, most system companies prefer avoiding long design cycles and using already developed chips. Moreover, aside from design complexity, there are implementation issues when various high speed chips are placed on the same board. As an example, routing high speed, Gbits/sec signals around the board is a very challenging task known to the person skilled in art.

In view of the above, methods and devices for fast reconfiguration of transceivers front end are needed.

SUMMARY

Reiterating what described above, fast reconfiguration of the transceivers' front ends in communication systems is highly desired and needed. Methods and devices taught in the present disclosure address such need.

According to a first aspect of the disclosure, a method of capacitive compensation for digital gain and/or phase control of an antenna array is provided, comprising: providing one or more lookup tables comprising gain and/or phase values of antennas in an antenna array; selecting entries to corresponding lookup tables of the one or more lookup tables through one or more gain and/or phase selection indices; based on the entries selected, accessing selected gain and/or phase values within the one or more lookup tables; and setting or resetting gains and phases of the antennas of the antenna array based on the selected gain and/or phase values.

According to a second aspect of the present disclosure, a control circuit is provided, comprising: command interpreter; a serial interface providing control commands to the command interpreter; and one or more lookup tables; wherein: the one or more lookup tables comprise gain and/or phase values of antennas of an antenna array; and the command interpreter is configured to generate, based on the control commands, one or more first indices to select first entries to the one or more lookup tables to access selected gain and/or phase values of the antennas of the antenna array.

According to a third aspect of the present disclosure, a gain and/or phase control circuit controlling a phased array system comprising one or more lookup tables comprising gain and/or phase values of antennas of the phased array system is provided, wherein: selecting entries to corresponding lookup tables of the one or more lookup tables are selected through one or more gain and/or phase selection indices; predefined gain and/or phase values within the one or more lookup tables are selected based the selecting entries; and gains and/or phases of the antennas of the phased array system are set or reset based on the predefined gain and/or phase values.

DETAILED DESCRIPTION

(3) Definitions

The term "slot" in data transmission is referred herewith to a digital transmission unit comprising a sequence of bits representing certain information (e.g. control or data).

The term "mode" is referred herewith to any combination of states and/or parameters in all circuits in a communication system. Here are few examples for such states:

Transmit, receive, neutral and sleep

Self-test, loopback, calibration, etc.

Switch control (referring to what state, ON or OFF, the switch is in) and bias control (referring to various bias values/states depending on operating conditions)

Examples of parameter are modulation center frequency, transceiver gain and transceiver phase (in multi-antenna) communication systems.

The term "configure" is referred herewith to set various states and parameters of various circuits in a communication system. The term "reconfigure" is referred herewith to change the settings of the communication system circuits. As an example, a transceiver may be configured to be in transmit mode at a first time instant. At a second time instant, such transceiver may be reconfigured to be in the receive mode depending on the operative conditions.

The term "lookup table" is referred herewith to a memory or a register wherein data is stored and an index comprising a plurality of bits may be used to select entries to such memory or register.

The term "serial interface" is referred herewith to a communication interface between two digital systems that transmits data as a series of voltage or current pulses down a wire. Examples of standardized serial interfaces are serial peripheral interface (SPI®) or Mobile Industry Processor Interface (MiPi®).

The term "command interpreter" is referred herewith to a digital circuit receiving input commands and outputting indices accordingly to select entries to lookup tables, registers or memories.

Figure 1:
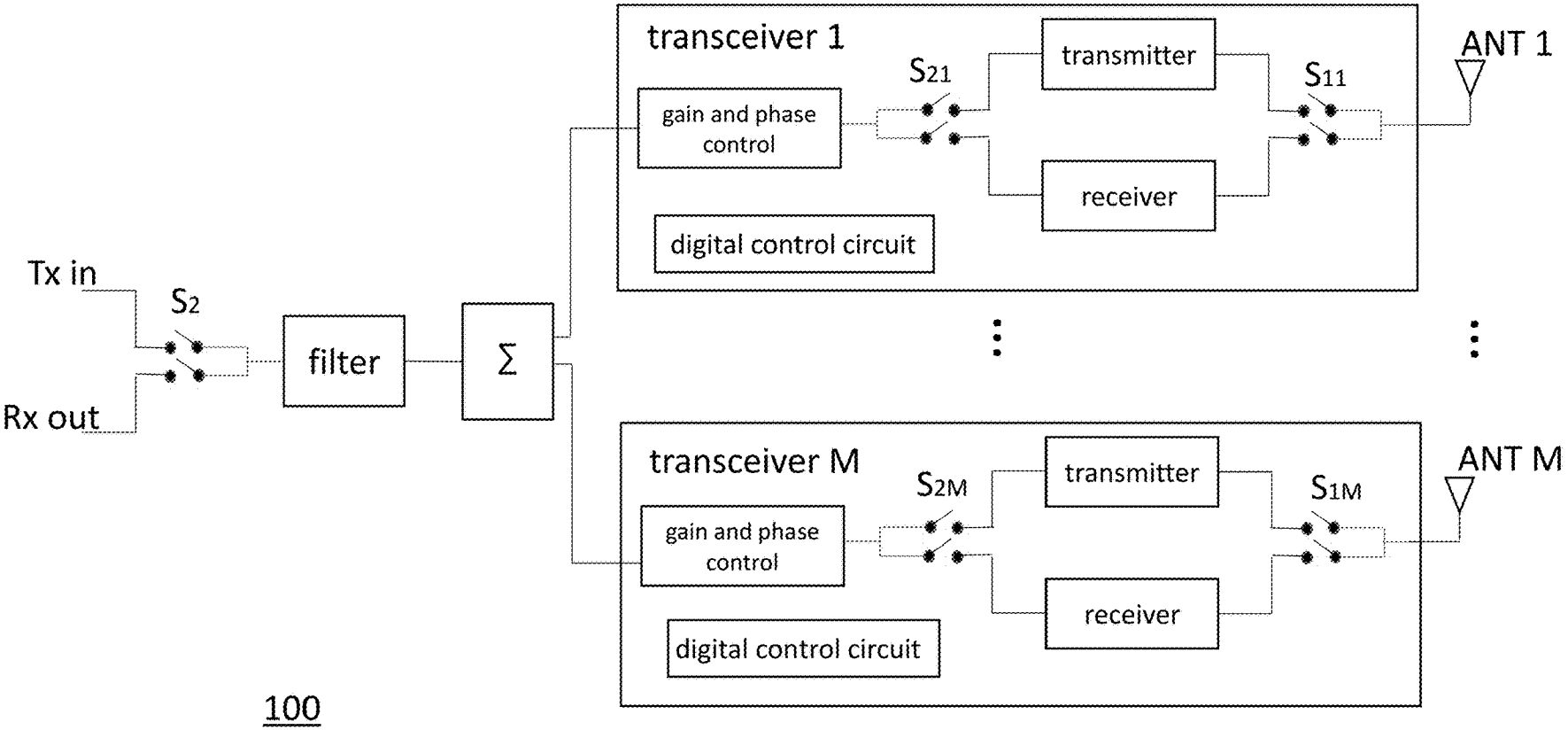
Fig.1 (PRIOR ART)
FIG. 1 shows a block diagram of a prior art multi-antenna communication system.
Figure 2:
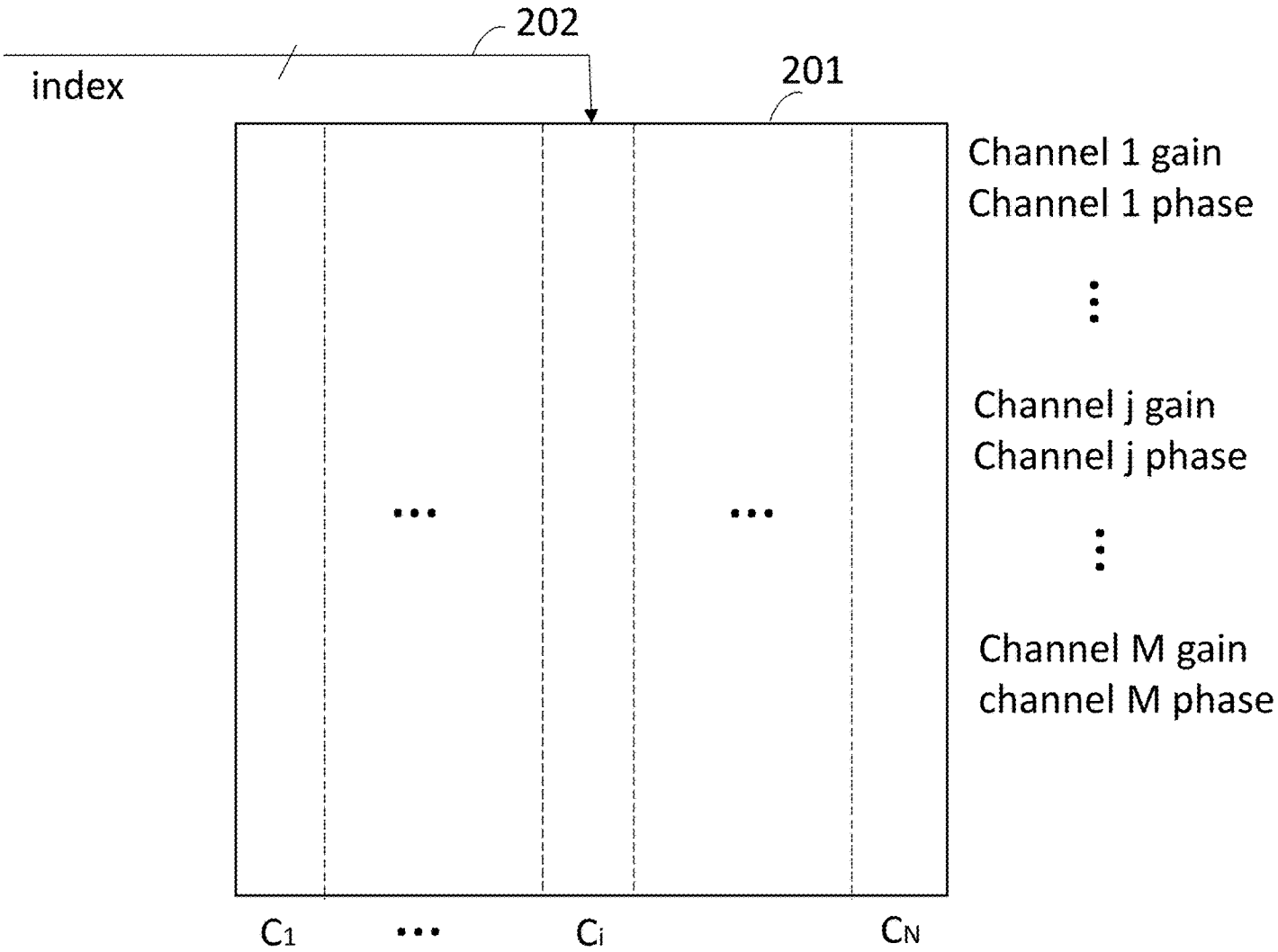
FIG. 2 shows a programmable lookup table containing transceiver gain and phase information related to a multi-antenna communication system with an antenna array and in accordance with an embodiment of the present disclosure.

FIG. 2 shows a programmable lookup table (201) according to an embodiment of the present disclosure. The programmable lookup table (201) may contain transceiver gains and phases corresponding to all transceivers of a multi-antenna communication system having M transceivers. As shown in FIG. 2, transceiver gain and phase are saved in the programmable lookup table (201) and organized in a column-wise fashion. In other words, each column (C1, . . . , Ci, . . . , CN) corresponds to a state of the transceivers and contains transceiver j gain and transceiver i phase where j=1, . . . , M. As an example, the programmable lookup table (201) may be structured into 128 columns, wherein each column may contain gain and phase information corresponding to various beam steering directions of an array of antennas. According to an embodiment of the present disclosure, an index (202) may be used to select the entry to the programmable lookup table (201). The index (202) comprises a plurality of bits that are part of a control command as will be described later in the disclosure. Continuing with the example above, an index comprising 7 bits may be used to address a programmable lookup table comprising 2^7=128 columns. In accordance with embodiments of the present disclosure, the programmable lookup table (201) data may be uploaded at start time of the system and may optionally be updated using a background process at a slower time scale compared to the timescale according to which the rest of the circuit may operate. It is known in the art that initial load of registers is often not time constrained. According to an embodiment of the present disclosure, data may also be stored in a non-volatile memory such as a fuse bank.

With continuous reference to FIG. 2, the person skilled in the art will appreciate that, by modifying a small number of bits of the entry index, access to a large number of configuration parameters may be made possible using the technique described above. As mentioned before, this will help overcome undesired delay issues associated with reconfiguration of various circuits within large multi-antenna systems with a complex design. Numerical examples further clarifying such benefit will be given later in this paper. With further reference to FIG. 2, the person skilled in art will understand that further embodiments according to the present disclosure may be envisaged wherein the data contained in the lookup table (201) may be organized in columns, in rows or a combination thereof.

Figure 3:
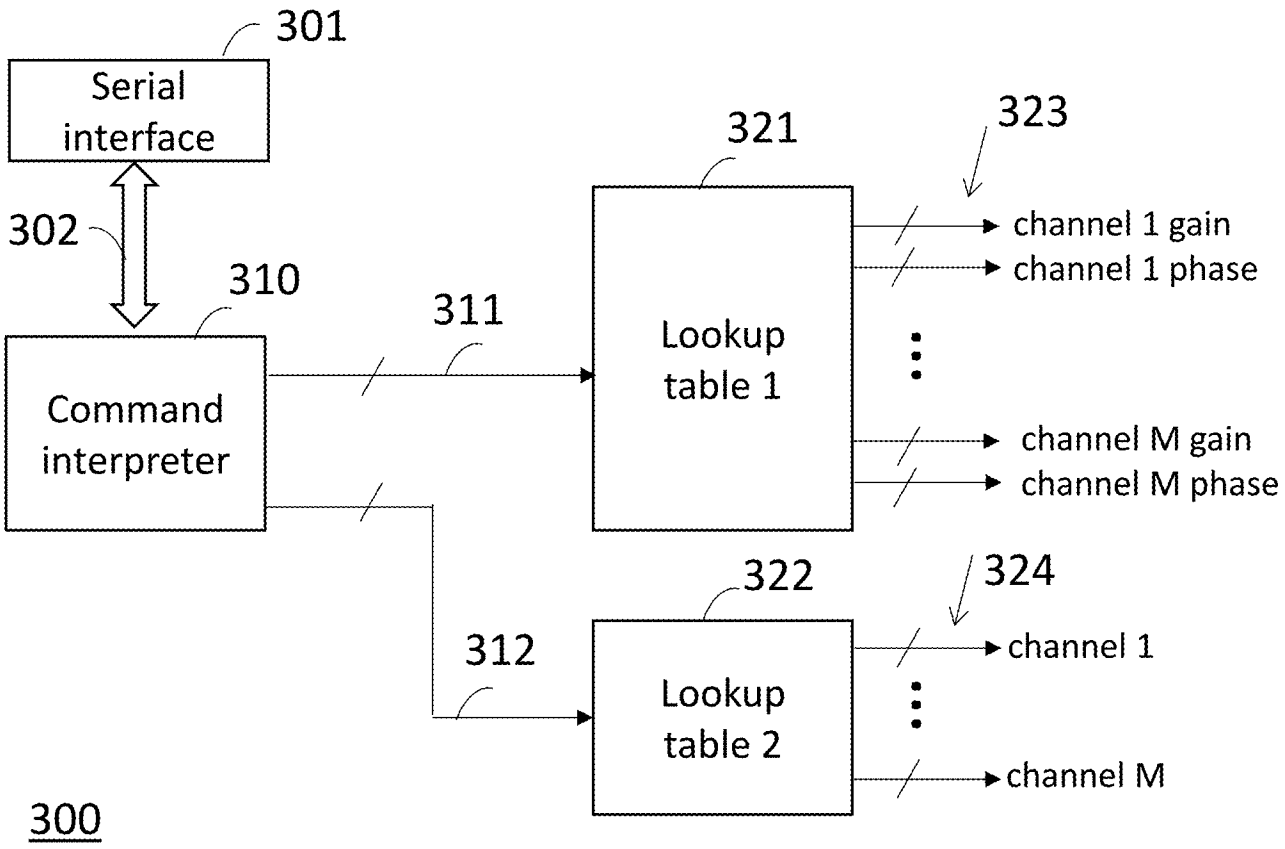
FIG. 3 shows a digital control circuit.

FIG. 3 shows a digital control circuit (300) in accordance with embodiments of the present disclosure. Also shown in FIG. 3, is a serial interface (301) providing control commands (302) to a command interpreter (310). The serial interface (301) may be a standardized serial interface (e.g. SPI® or MiPi®). After analyzing the control commands (302) received from the serial interface, the command interpreter (310) outputs a first and a second index (311, 312) to a first and a second lookup table (321, 322) respectively. The first index (311) and the second index (312) are used to select entries to the first lookup table (321) and the second lookup table (322). In accordance with embodiments of the present disclosure, the digital control circuit (300) may be implemented as part of a multi-antenna communication system having M transceivers, wherein M is an integer larger than or equal to 1. The first lookup table (321) contains gain and phase values corresponding to transceivers i, i=1, . . . , M of the multi-antenna communication system. The second lookup table (322) may contain information related to various modes of transceivers and circuits within the multi-antenna communication system, and corresponding to transceivers i, i=1, . . . , M. In accordance with further embodiments of the present disclosure, the first and the second lookup tables (321, 322) are programmable. The person skilled in art will understand that, without departing from the spirit and scope of the invention, embodiments may be made with one or more lookup tables. In other words, data can be saved in one or more lookup tables.

Figure 4:
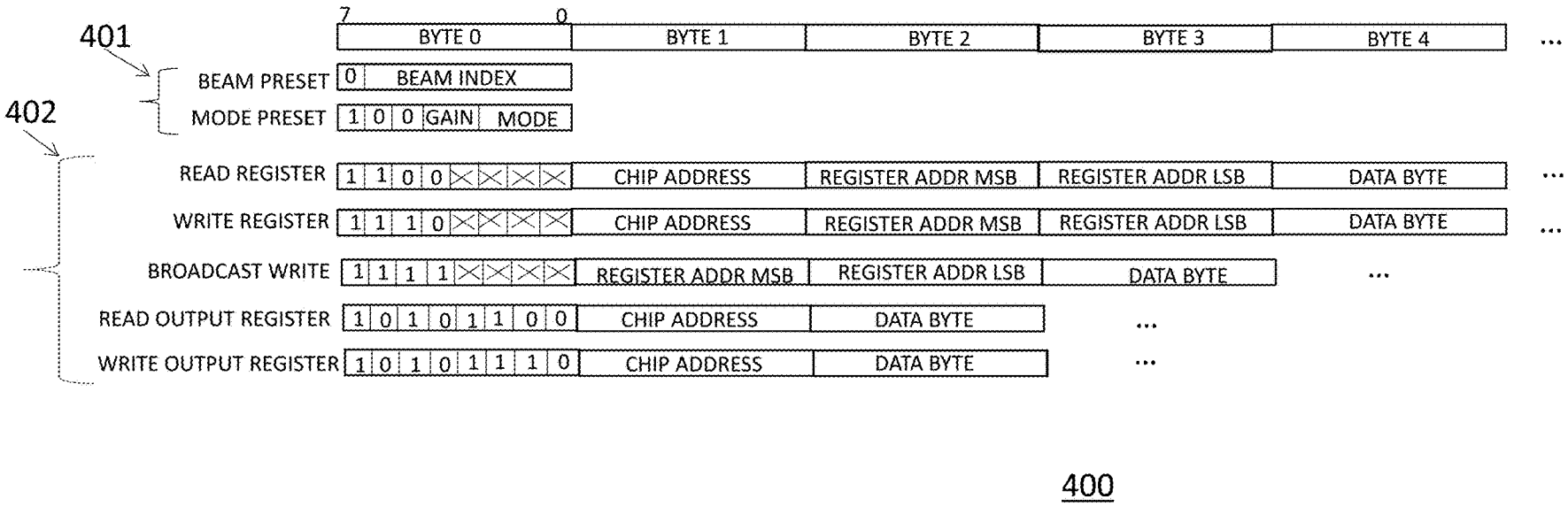
FIG. 4 shows static and dynamic control commands according to embodiments of the present disclosure.

FIG. 4 shows control commands (400) that may be used by the serial interface (301) of FIG. 3 in accordance with an embodiment of the present disclosure. The control commands (400) comprise two different types of commands: dynamic commands (401) and static commands (402). The dynamic commands (401) are short (e.g. 8-bit) serial messages containing a message identification (ID) header and one or more indices. Referring also to FIG. 3, the one or more indices are used to select the entry of a lookup table which contains data required to reconfigure various system transceivers and/or electronic circuits for various modes and/or transceiver gain and phase values. By way of example, an 8-bit BEAM PRESET command may contain a single header ID bit (e.g. 0) and 7 beam index bits. Based on the beam index bits, one of the 2^7=128 values representing transceiver gain and phase information is selected and applied.

In order to highlight the advantage of the methods and devices disclosed, a communication system with 128 transceivers using 9 phase control bits and 9 gain control bits is considered. In such system, at least a total of 18×128=2.3 Kbits are required to be changed during a reconfiguration. This may take a prohibitively long time using existing solutions. The person skilled in the art will appreciate that, continuing with the same example, the reconfiguration is made possible by only writing an 8-bit BEAM PRESET command resulting in improvement of the reconfiguration time. In the same example, a total of 18×128*128=295 Kbits are loaded at the start time. This information may be updated, during operative conditions and using a background process if the transceiver gain and phase values are to be adapted. The dynamic commands (401) have no chip address field because they are broadcast to all electronic circuits on the same interface. According to embodiments of the present disclosure the background process may be performed using a static write command with the serial interface (301) of FIG. 3. The MODE PRESET command comprises a 3-bit command header, a 2-bit gain field, and a 3-bit mode index field. The mode index field allows access to 8 different modes, including transmit, receive, neutral, sleep etc. The READ REGISTER command comprises the command header (e.g. 1100XXXX) followed by chip address byte then two bytes of register/lookup table starting address. The write register command is similar to read register. The BROADCAST REGISTER, READ OUTPUT REGISTER, AND WRITE OUTPUT REGISTER are used for various read/write operations.

With further reference to FIG. 4, dynamic command MODE PRESET may comprise 8 bits, and may contain 3 command ID bits, 2 common gain index bits, and 3 mode index bits. The common gain index bits contain an index to a common gain lookup table. This lookup table stores 4 sets of bits which control gain applying to all transceivers. Similarly, the 3 mode index bits select one of 8 sets of bits which configure the transceivers' modes of operation such as transmit, receive, sleep, etc.

The static commands (402) are read/write messages, primarily writing data to registers/lookup tables at start time and updating the lookup table as a background process and at a slower time scale. The static commands (402) are distinguished from dynamic commands by a variable-length command header in the first byte(s) (or word(s), in some implementations) of the serial message. The static commands (402) are typically longer than the dynamic commands, variable length, auto-incrementing register write operations. The static commands (402) do not need to be fast, and are typically used for initialization as well as background updating of lookup table data used by the dynamic commands (401). Each individual command of both types is distinguished by the command interpreter (310) in the device. Based on the individual command, the command interpreter takes certain appropriate actions. The variable length nature of the command header is more efficient in terms of using bit usage to distinguish multiple commands of variable length. For example a "0" leading bit alone distinguishes a beam index command, providing 7 bits of a byte-length command for beam index. If the leading bit is "1", then other commands are encoded depending on additional header bits.

A number of embodiments of the invention have been described. It is to be understood that various modifications may be made without departing from the spirit and scope of the invention. For example, some of the steps described above may be order independent, and thus can be performed in an order different from that described. Further, some of the steps described above may be optional. Various activities described with respect to the methods identified above can be executed in repetitive, serial, or parallel fashion.

It is to be understood that the foregoing description is intended to illustrate and not to limit the scope of the invention, which is defined by the scope of the following claims, and that other embodiments are within the scope of the claims. (Note that the parenthetical labels for claim elements are for ease of referring to such elements, and do not in themselves indicate a particular required ordering or enumeration of elements; further, such labels may be reused in dependent claims as references to additional elements without being regarded as starting a conflicting labeling sequence).

What is claimed is:

1. A control circuit comprising:

command interpreter;

a serial interface providing control commands to the command interpreter; and one or more lookup tables;

wherein:

the one or more lookup tables comprise gain and/or phase values of antennas of an antenna array; and the command interpreter is configured to generate, based on the control commands, one or more first indices to select first entries to the one or more lookup tables to access selected gain and/or phase values of the antennas of the antenna array.

2. The control circuit of claim 1, wherein the serial interface is a standardized serial interface such as serial peripheral interface (SPI®) or Mobile Industry Processor Interface (MiPi®).

3. A communication system comprising:

the control circuit of claim 2; and a plurality of transceivers connected to corresponding antennas of the antenna array through corresponding switches, wherein the communication system is configured to set or reset gains and/or phases of the antennas of the antenna array based on the selected gain and/or phase values of the antennas of the antenna array.

4. The communication system of claim 3, wherein the one or more lookup tables further comprise:

transceivers control values;

switches control values; and communication system parameters values.

5. The communication system of claim 4, wherein:

the command interpreter is further configured to generate, based on the control commands, one or more second indices to access selected transceivers control values, selected switches control values and/or selected communication system parameters; and the communication system is configured to set or reset:

states of transceivers based on the selected transceivers control value;

states of switches based on the selected switches control values; and/or parameters of the communication system based on the communication system parameters values.

6. The communication system of claim 5, wherein the states of the transceivers and the corresponding switches are selected from one of a) transmit, b) receive, c) neutral, d) sleep, e) loopback, f) self-test, and g) calibration, and the parameters of the communication system comprise a modulation center frequency.

7. The control circuit of claim 6, wherein the control commands comprise each a plurality of bits and a variable header indicating a command control type.

* * * * *